US005727692A

United States Patent [19]

Large et al.

[11] Patent Number: 5,727,692

[45] Date of Patent: Mar. 17, 1998

[54] APPARATUS AND METHOD FOR CHECKING AN ENVELOPE FOR CONTENTS

[75] Inventors: Timothy Andrew Large, Cambridge; David Russell Anderson, Herts, both of United Kingdom

[73] Assignee: Stielow GmbH & Co., Norderstedt, Germany

[21] Appl. No.: 374,690

[22] PCT Filed: Aug. 19, 1993

[86] PCT No.: PCT/GB93/01765

§ 371 Date: Jan. 24, 1995

§ 102(e) Date: Jan. 24, 1995

[87] PCT Pub. No.: WO94/04378

PCT Pub. Date: Mar. 3, 1994

[30] Foreign Application Priority Data

Aug. 19, 1992 [GB] United Kingdom ..... 9217568

[51] Int. Cl.[6] ..... B07C 5/12

[52] U.S. Cl. ..... 209/603; 209/577; 209/604; 209/900; 271/263; 271/265.04

[58] Field of Search ..... 209/576, 577, 209/587, 600, 601, 603, 604, 900; 271/262, 263, 265.04; 324/230

[56] References Cited

U.S. PATENT DOCUMENTS

| | | | |
|---|---|---|---|
| 4,576,287 | 3/1986 | Bingham et al. | 209/601 |
| 5,067,704 | 11/1991 | Tsuihiji et al. | 271/262 |
| 5,174,562 | 12/1992 | Mizunaga et al. | 271/265.04 X |
| 5,238,123 | 8/1993 | Tovini et al. | 209/604 X |
| 5,265,733 | 11/1993 | Hoekstra et al. | 209/603 |
| 5,293,118 | 3/1994 | Grossmann et al. | 271/265.04 X |

FOREIGN PATENT DOCUMENTS

| | | | |
|---|---|---|---|
| 0 169 145 | 1/1986 | European Pat. Off. . | |
| 0 225 288 | 6/1987 | European Pat. Off. . | |
| 225288 | 6/1987 | European Pat. Off. | 271/263 |
| 0 392 572 | 10/1990 | European Pat. Off. . | |
| 2 685 650 | 7/1993 | France . | |

*Primary Examiner*—Tuan Nguyen

[57] ABSTRACT

A method and apparatus for checking an envelope for contents is provided to determine whether or not an envelope has been completely emptied. The thickness of the envelope is measured at a plurality of points along the envelope. From the measured thickness, the thickness, or an integer multiple of the thickness, of the material of the envelope is determined. The thickness of the envelope measured at the plurality of points is compared with the determined material thickness, or integer multiple of the thickness, of the envelope. On the basis of that comparison, a determination is made as to whether or not the envelope has contents therein. The apparatus and method do not rely on measuring the opacity of the envelope.

29 Claims, 9 Drawing Sheets

APPARATUS AND METHOD FOR CHECKING AN ENVELOPE FOR CONTENTS

BACKGROUND OF THE INVENTION

The present invention relates to an apparatus and method for checking an envelope for contents.

Many large commercial and government organizations have mail receiving departments which process large volumes of mailing envelopes. The envelopes are often opened automatically and held while the contents are manually removed. The waste envelope is then discarded. It is often desirable to check that the envelope has been properly emptied and that no residual contents remain in the discarded envelope. This process is known as "candling". Some previous candling processes have used optical detectors to measure the envelope opacity, it generally being the case that contents in an envelope increase the envelope opacity. However, these techniques have proved to be unreliable since the opacity of a particular envelope depends not only on the presence of contents, but also on the presence of printing and the fibre density of the envelope paper. A particular case is that of envelopes made of recycled paper, which may be almost opaque in the visible and near infra-red optical spectrum.

SUMMARY OF THE INVENTION

According to a first aspect of the present invention, there is provided a method of checking an envelope for contents, the method comprising the steps of:

measuring the thickness of the envelope at a plurality of points along the envelope;

determining the thickness, or a multiple of the thickness, of the material of the envelope from said measured thickness; and, comparing the thickness of the envelope measured at the plurality of points with the determined material thickness, or the multiple of the thickness, of the envelope and determining on the basis of such comparison whether or not the envelope has contents therein.

It has been found that the thickness of the material of envelopes is extremely well controlled by paper manufacturers (which opacity is not) and the present invention takes advantage of this in measuring the envelope thickness. As well as looking for paper contents (such as cheques) remaining in an envelope, the present invention may be used to check for envelopes containing staples, pins, badges, or other similar relatively thin objects.

A mechanical thickness gauge may be used to measure the thickness of the envelope. The mechanical thickness gauge may include a single roller. Alternatively, in some circumstances, it may be preferable to use a plurality of rollers, for example, three rollers. In either case each roller may be supported to pivot about a pivot point, the thickness of the envelope being measured by monitoring pivotable movement of the roller as it passes over the envelope. Pivotal movement of the roller may be monitored by optical means. Other thickness gauges and monitoring means are described in more detail below.

A non-contact method may be used for measuring the thickness of the envelope.

The length of the "envelope" may be measured. This allows items which are clearly too large or too small to be envelopes to be rejected.

According to a second aspect of the present invention, there is provided apparatus for checking an envelope for contents, the apparatus comprising:

means for measuring the thickness of an envelope at a plurality of points along the envelope;

means for determining the thickness, or a multiple of the thickness of the material of the envelope from said measured thicknesses; and, means for comparing the measured thickness of the envelope with the determined material thickness, or the multiple of the thickness, of the envelope and determining on the basis of such comparison whether or not the envelope has contents therein.

The thickness measuring means may comprise a mechanical thickness gauge. The mechanical thickness gauge may include a single roller. Alternatively, the mechanical thickness gauge may include a plurality of rollers. Three rollers may be used.

The apparatus may comprise means for transporting envelopes through the thickness measuring means.

Where one or more rollers is used as the thickness measuring gauge, the single roller or each roller may be pivotably mounted on a support. The roller or rollers ride over the envelope, pivoting up and down according to varying thickness of the envelope.

Where one or more rollers is pivotally mounted on a support, an optical detector may be provided for monitoring pivotal movement of the roller or rollers. Other thickness gauges and monitoring means are described in more detail below.

BRIEF DESCRIPTION OF THE DRAWINGS

Two examples of the present invention will now be described with reference to the accompanying drawings, in which.

DESCRIPTION OF THE PREFERRED EMBODIMENTS

Figure 1:
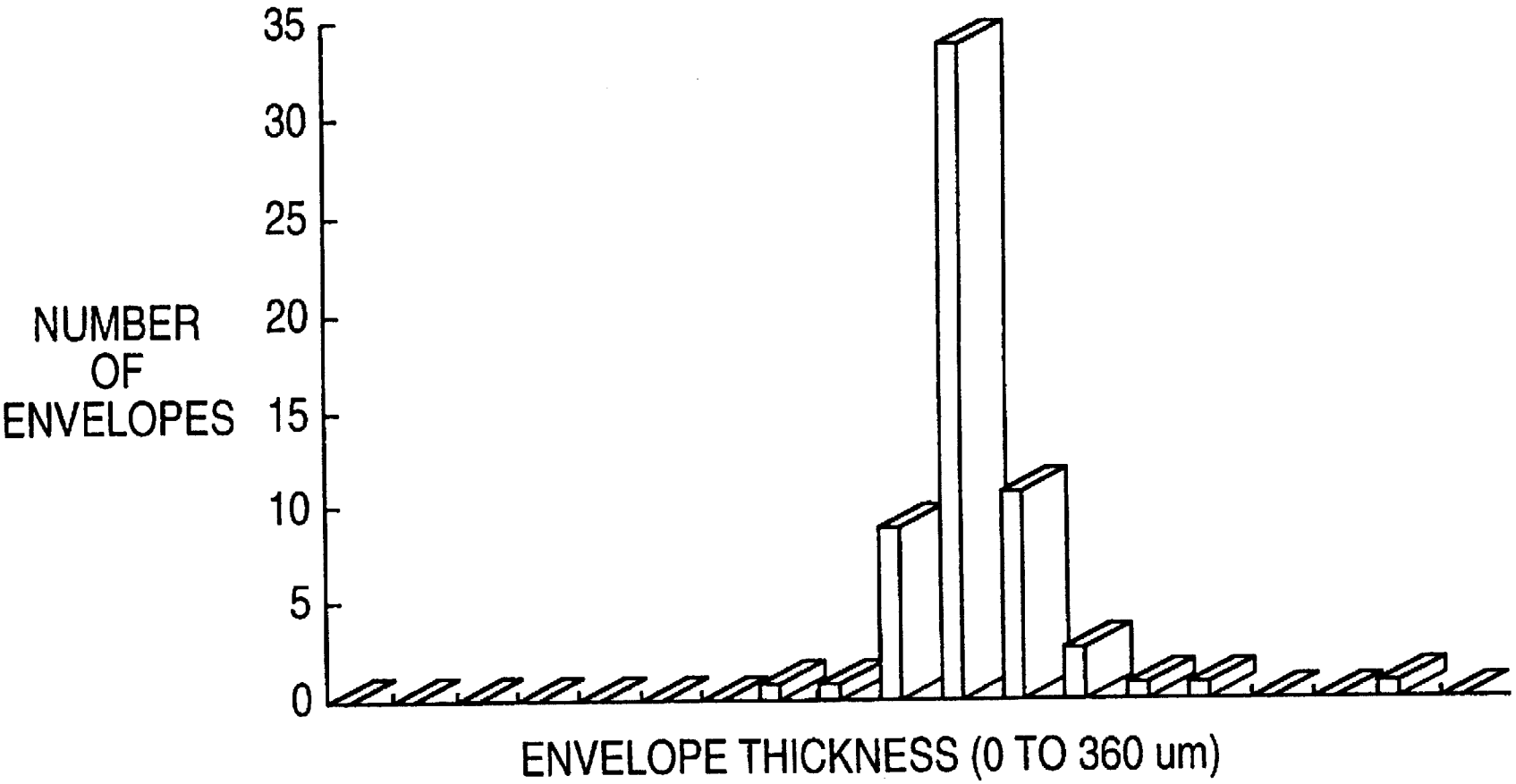
FIG. 1 is a histogram of variations of thickness of a typical sample of envelopes.

It has been found that the thickness of envelopes is very well controlled by paper manufacturers. FIG. 1 shows the result of a measurement of mean thickness of envelopes in a typical sample. The mean thickness of the envelope was found to be 204 μm (i.e. a material thickness of 102 μm) with an rms deviation of only 20 μm.

Figure 2A:
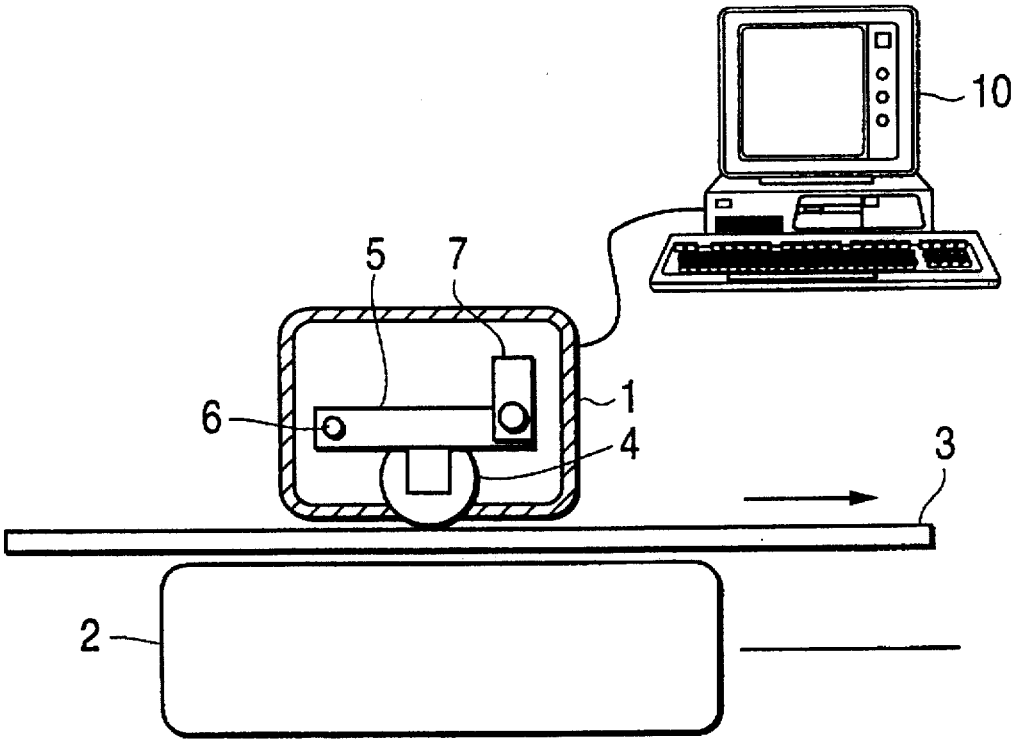
FIGS. 2(*a*) and 2(*b*) are a side view and a plan view respectively showing the apparatus schematically.
Figure 2B:
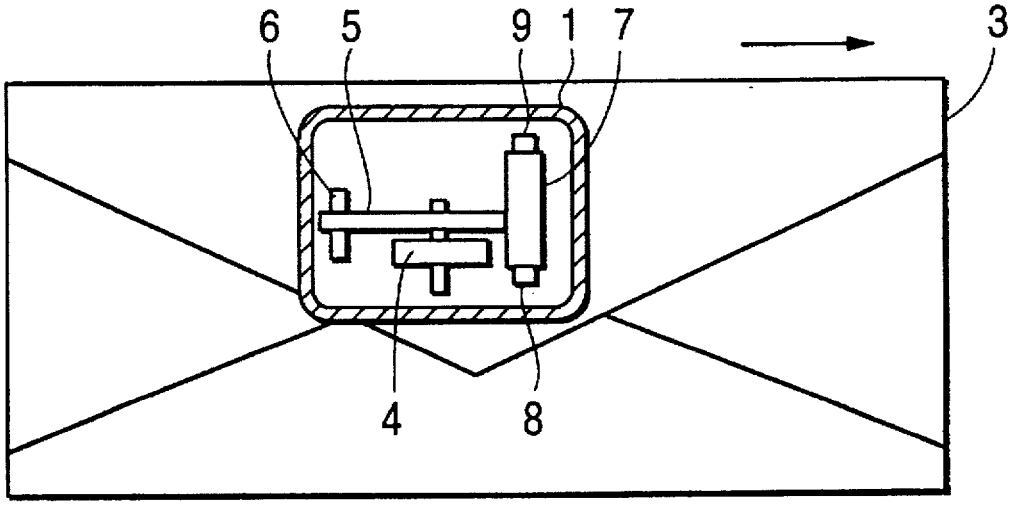

As shown in FIGS. 2(*a*) and 2(*b*), a first example of apparatus in accordance with the present invention has a housing 1 positioned above a platen 2. Envelopes 3 are continuously passed through the apparatus between the housing 1 and platen 2.

The housing 1 supports a roller 4 which is freely rotatably mounted on an arm 5. The roller 4 may be a narrow steel wheel or roller bearing, for example.

The arm 5 is pivotably mounted at a pivot point 6 on the housing 1. The arm 5 may be biased by a spring (not shown) against the platen 2. In an alternative embodiment, a second roller (not shown) may be used in place of the platen 2. As the envelope 3 passes between the sprung roller 4 and the platen 2, the roller 4 rides up and down according to the varying thickness of the envelope 3, the arm 5 pivoting about the pivot point 6.

Movement of the roller 4 up and down is monitored by an optical sensor 7 which consists of a light source 8 and a light detector 9 respectively disposed either side of the arm 5 so that the arm 5 moves up and down between the light source 8 and light detector 9. The light detector 9 is a large area detector which has an area of say, 7 $mm^2$. As the roller 4 moves up and down, the amount of light received by the detector 9 from the source 8 varies as the arm 5 breaks the light beam and the amount of light received by the detector 9 can be correlated with the thickness of the envelope 3. The output of the light detector 9 is passed to a microprocessor 10 which operates on the data as described in more detail below.

Figure 3A:
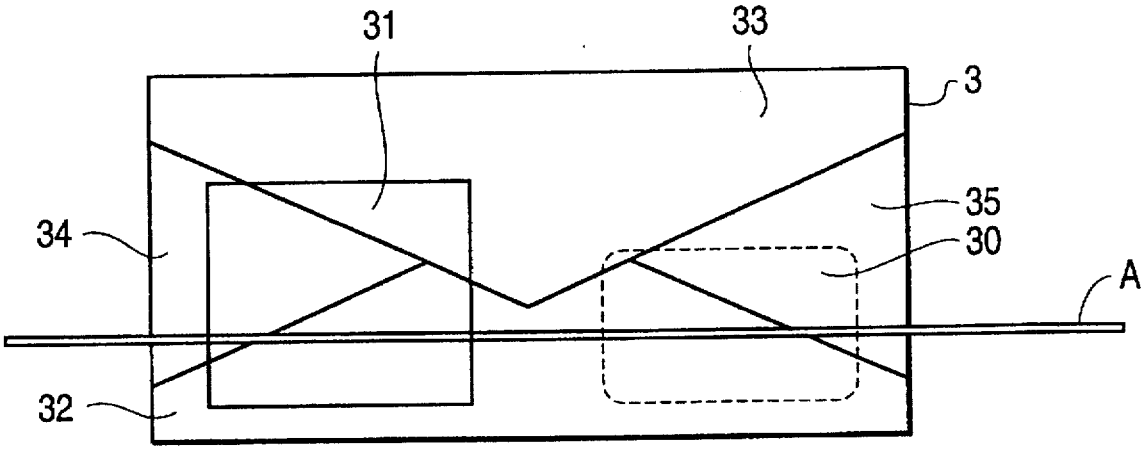
FIGS. 3(*a*) and 3(*b*) show an envelope having a window and contents and a contour map showing thickness variation over the length of the envelope respectively.
Figure 3B:
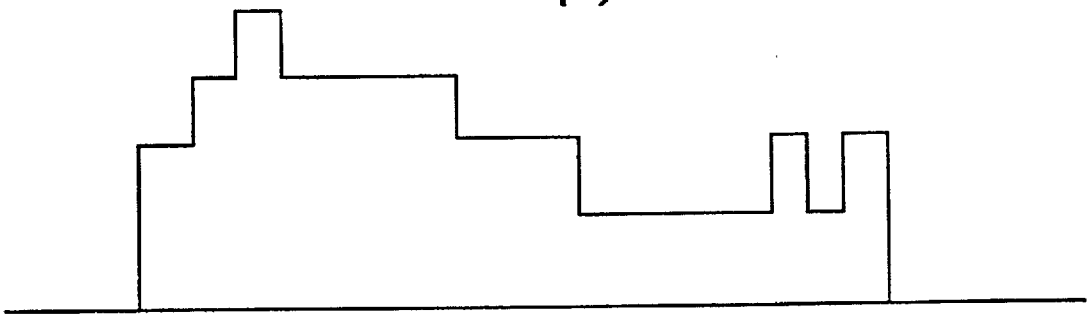

FIG. 3(*a*) shows an envelope 3 having a window 30 and containing a sheet of paper 31 which has a length just under half of the length of the envelope 3. The envelope 3 has a lower flap 32 and an upper flap 33 which partially overlies the lower flap 32. The envelope 3 also has side flaps 34, 35. The path of the roller 4 over the envelope 3 is indicated by a line A. The thickness of the material of the envelope 3 can be taken to be substantially 102 μm whilst the thickness of a conventional transparent window is usually 10 to 20 μm. FIG. 3(*b*) is effectively a contour map of the envelope and it can be seen how the thickness varies as the roller 4 moves from left to right over the side flap 34, the contents 31, the lower flap 32, the side flap 34, off the contents 31, onto the window 30, over the side flap 35, off the lower flap 32, and then off the window 30 back to the double thickness of the envelope.

Figure 4A:
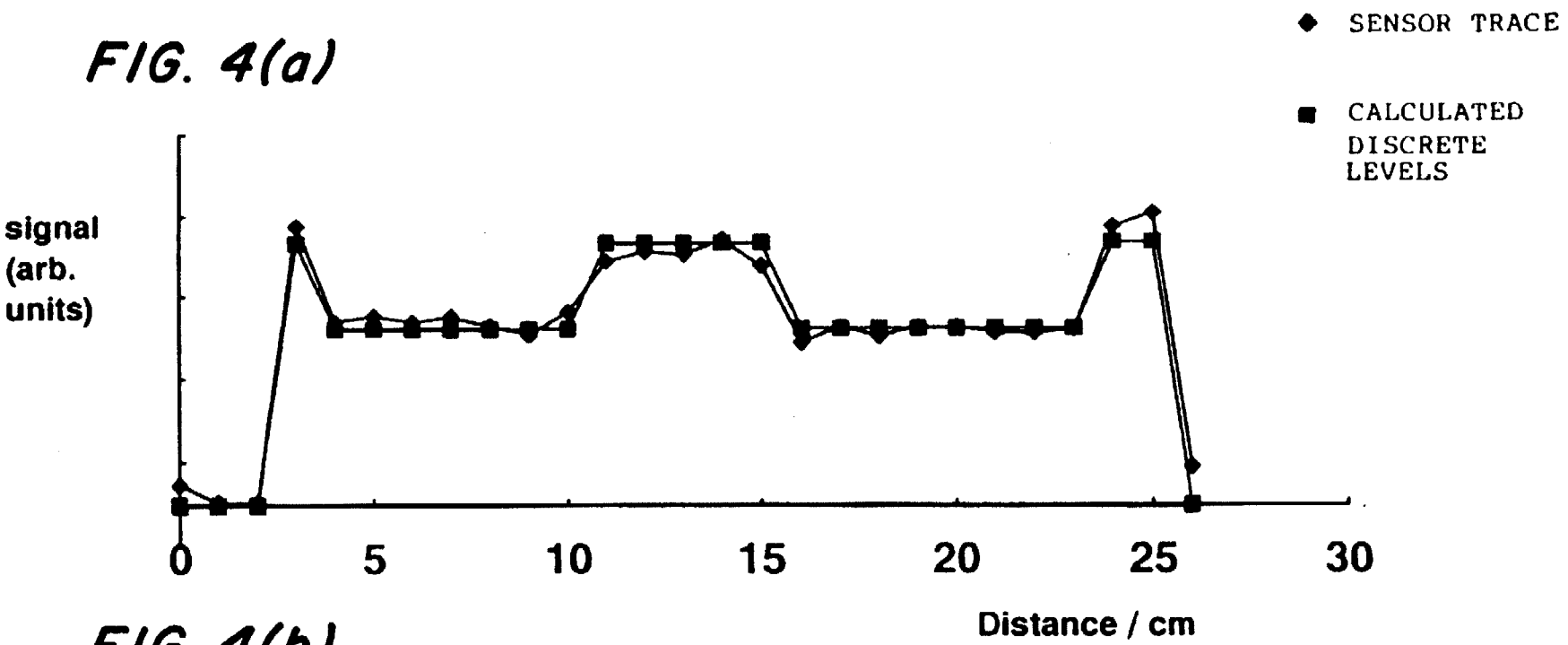
FIG. 4*a* & *b* is a graph showing the results of the measurements made by the thickness gauge over the length of an envelope schematically shown in the drawing, together with the calculated discrete levels.
Figure 4B:
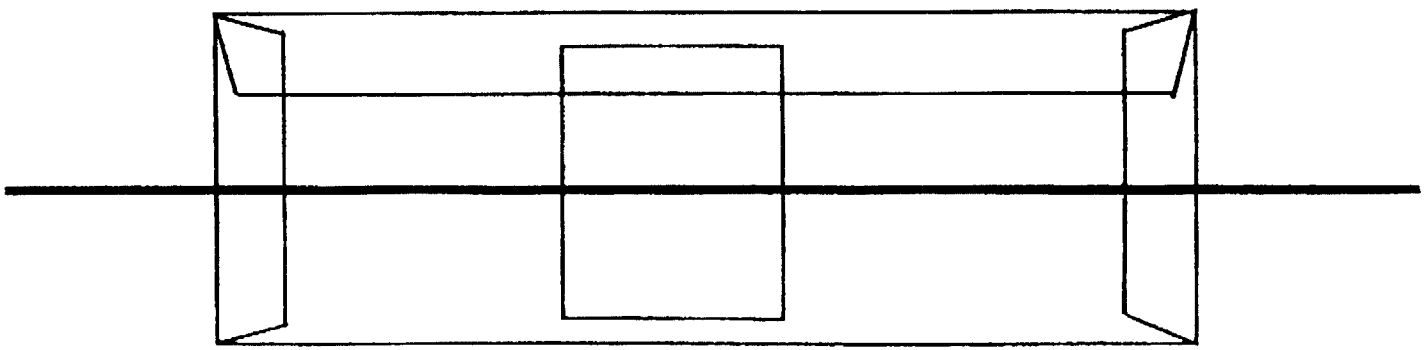
Figure 5:
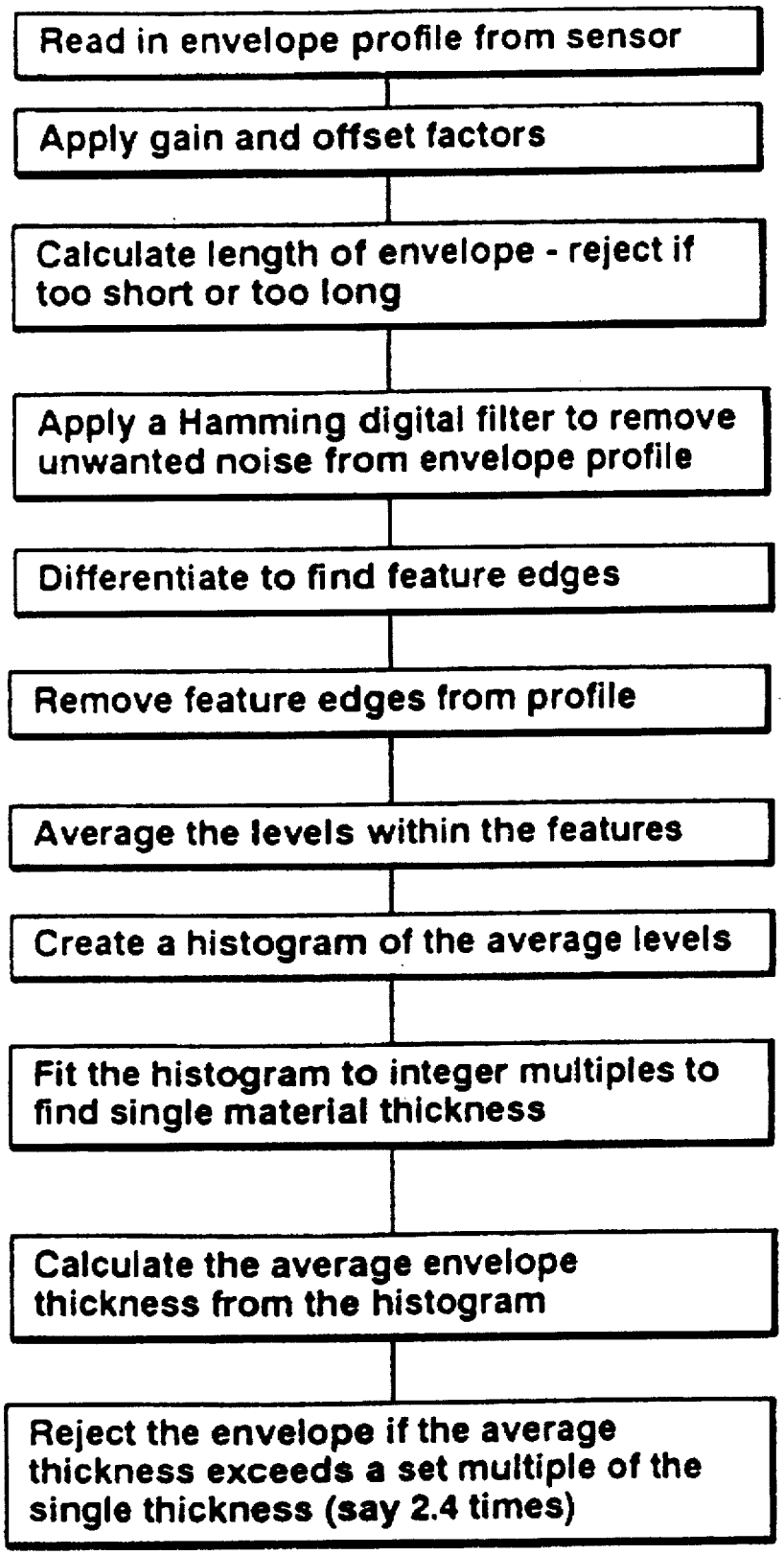
FIG. 5 is a flow chart of an example of a method in accordance with the present invention.

FIG. 4 shows the sensor trace (indicated with "♦") for another typical envelope, the envelope being shown below the trace. FIG. 5 is a flow chart setting out the steps involved in the present method. The raw data from the sensor is passed to the microprocessor 10 which then analyses the data. The offset of the sensor is removed and the gain of the sensor is corrected if required, effectively to standardise the output of the sensor. The length of the envelope is checked (by determining the positions of the start and finish of readings) so that items which are clearly too large or too small to be envelopes can immediately be rejected for manual inspection.

A filter is then used to remove mechanical and electrical noise from the signal. Following smoothing of the data signals using the filter, the gradient between adjacent points is measured so that the transitions between areas of different thicknesses can be identified. Once the edges of adjacent areas of different thicknesses have been identified, the average level between those edges can be calculated, thus providing discrete levels of thickness as shown in the second trace in FIG. 4 (indicated by "■"). A relatively simple contour map of the envelope is therefore obtained from the readings from the sensor 7.

Having obtained the contour map for the envelope, it is then necessary to analyse the distribution of the thicknesses across the envelope. The microprocessor 10 effectively draws up a histogram of measured thicknesses which are then analysed to find integer multiples of what can be assumed to be the single material thickness of the envelope. The single material thickness is thereby determined. The average thickness over the envelope is then calculated from the histogram and the envelope is rejected for manual inspection if the average thickness is significantly more than twice the single material thickness (say 2.4×the single material thickness) as it can be assumed that the envelope is not empty in such a case. Note that the average thickness can be used since it is assumed that if any region of increased thickness is very short, it is likely to be insignificant (e.g. a postage stamp) or something which is larger, but folded over, which would increase the average thickness above the cut off of 2.4×the single material thickness.

Figure 6:
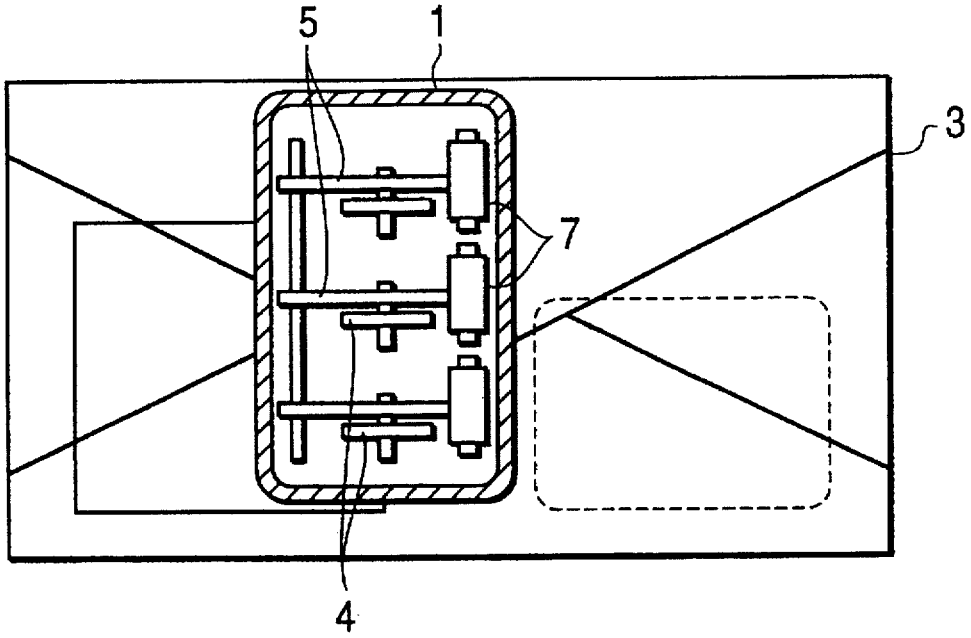
FIG. 6 is a schematic plan view of a second example of the apparatus of the present invention.

Since envelopes may have contents which do not extend over the entire width of the envelope, it may be desirable to use a plurality of sensors 7 in an array across the width of the envelope. In FIG. 6, three sensors 7 are shown, each of which has a corresponding roller 4 mounted on a pivotable arm 5 within the housing 1. The outputs of the three sensors are operated on to provide a single output corresponding to the output of what may be termed a "virtual sensor". This is done by taking the minimum of the uppermost two sensors 7 in FIG. 5, and taking the minimum of the lowermost two sensors 7 in FIG. 5, and then taking the maximum of the two minima as the output data. This virtual sensor data may then be processed as described above. The effect of this is to ignore any feature which occurs on only one sensor, such as edge flaps of the envelope, diagonal cross-over flaps and, to some extent, any envelope window.

Figure 7:
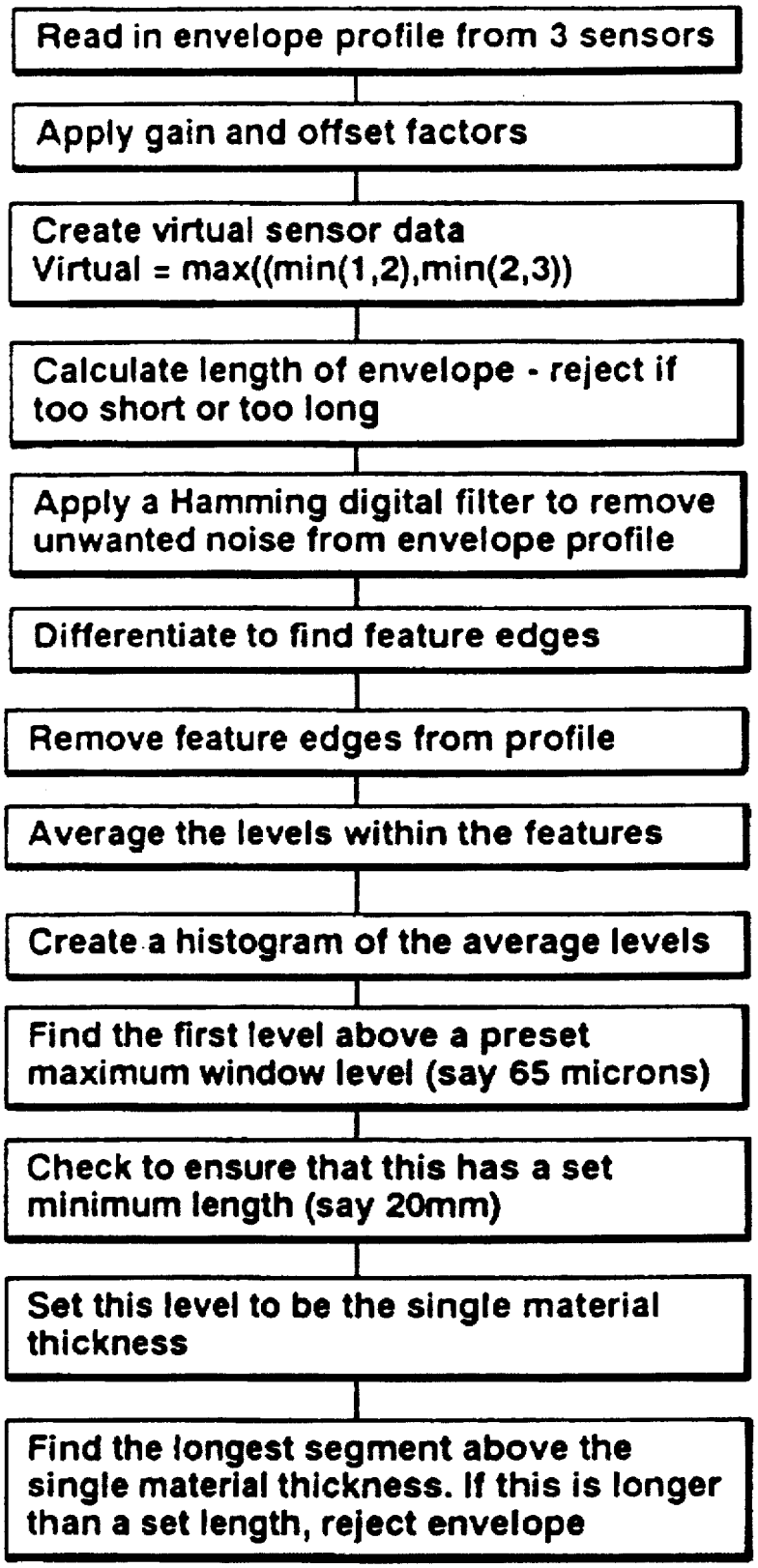
FIG. 7 is a flow chart of a second example of a method in accordance with the present invention.
Figure 8A:
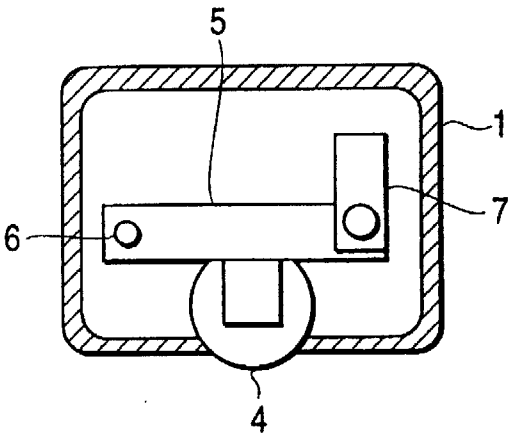
FIGS. 8(*a*) to (*d*) are schematic diagrams of examples of different mechanical thickness sensors.
Figure 8B:
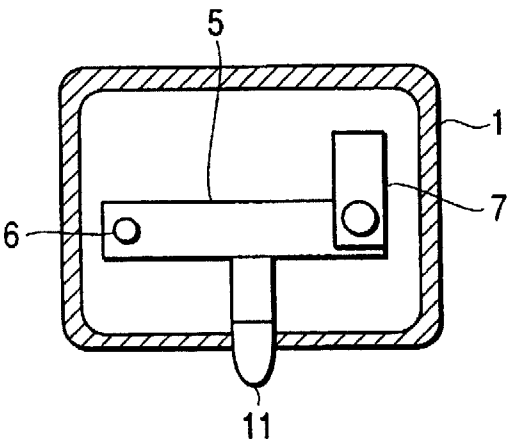
Figure 8C:
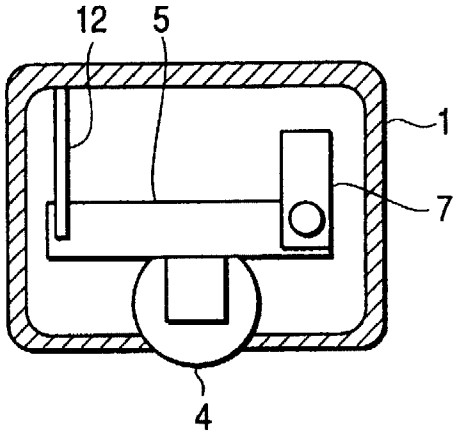
Figure 8D:
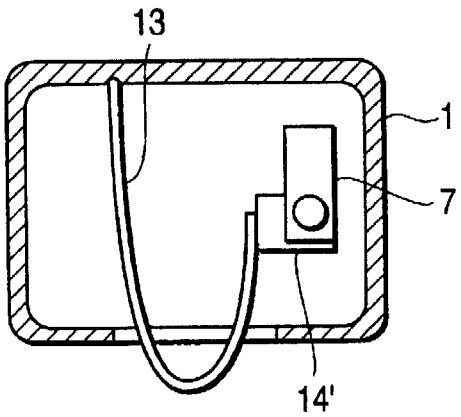
Figure 9C:
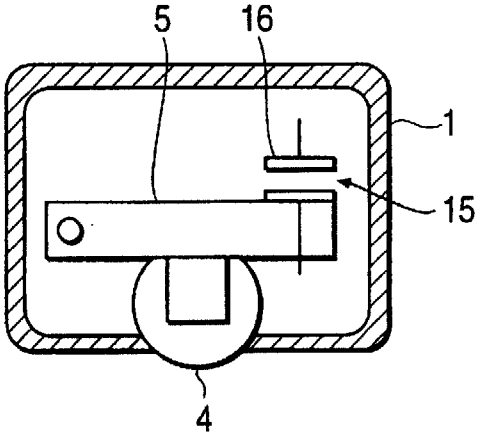
FIGS. 9(*a*) to (*d*) are schematic diagrams of examples of different techniques for determining the thickness measured by the thickness sensor; and, FIG. 10 is a diagram showing apparatus for measuring the thickness by a non-contact method.
Figure 9D:
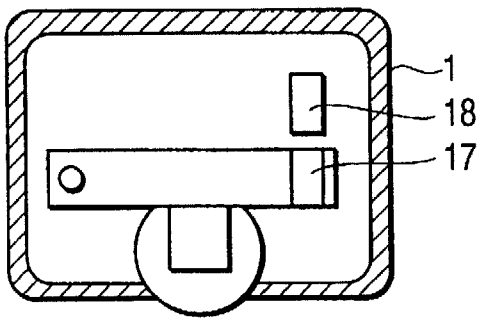
Figure 9A:
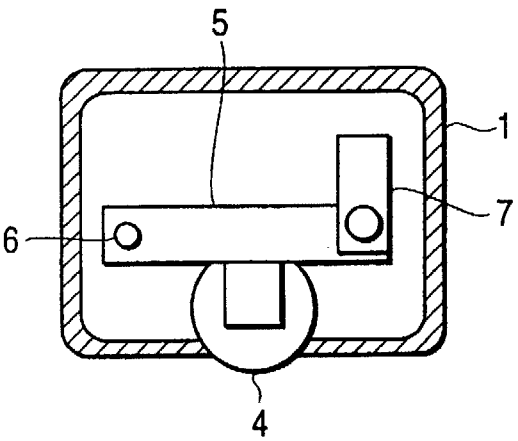
Figure 9B:
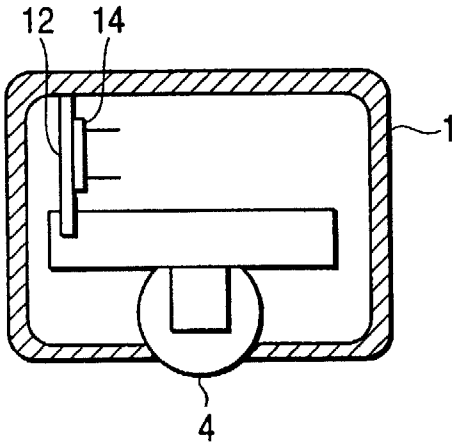

FIG. 7 is a flow chart showing an example of the method using three sensors rather than the single sensor example described in detail above. A further difference from the method described above is that, in this case, it is assumed that the envelope has been cut on three sides and has been fully opened out. This means that, effectively, a single sheet rather than a double-sheet envelope passes through the apparatus.

Similarly to the first example, the raw data from the three sensors is passed to the microprocessor 10 which then analyses the data. The offset of each of the sensors is removed and the gain of each of the sensors is corrected if required, effectively to standardize the output of the sensors. Then, a single output is passed for further processing by taking the minimum of the uppermost two sensors 7 in FIG. 5, and taking the minimum of the lowermost two sensors 7 in FIG. 5, and then taking the maximum of the two minima as the output data.

The length of the envelope is checked (by determining the positions of the start and finish of readings) so that items which are clearly too large or too small to be envelopes can immediately be rejected for manual inspection.

A filter is then used to remove mechanical and electrical noise from the signal. Following smoothing of the data signals using the filter, the gradient between adjacent points is measured so that the transitions between areas of different thicknesses can be identified. Once the edges of adjacent areas of different thicknesses have been identified, the average level between those edges can be calculated, thus providing discrete levels of thickness as shown in the second trace in FIG. 4 (indicated by "■"). A relatively simple contour map of the envelope is therefore obtained from the readings from the sensor 7.

Having obtained the contour map for the envelope, it is then necessary to analyse the distribution of the thicknesses across the envelope. The microprocessor 10 effectively draws up a histogram of measured thicknesses and looks for the first level above a preset minimum, of say 65 μm. (This minimum thickness should not be set at too high a level as airmail envelopes are relatively thin and inaccurate scanning of airmail envelopes may result. On the other hand, the minimum thickness should not be set too low as false readings may result.) A check is then made to ensure that this thickness extends over some minimum length of, say 20 mm. This determined level is set to be the main level as it will correspond to the thickness of the material of the envelope since any window, or any short regions of thickness above 65 μm, for example, where flaps may still be folded over, are ignored.

Having found the main level, the length of any regions having a thickness greater than the main level is determined. If the length (i.e. the extent over the envelope) of any of the regions is greater than a predetermined set length, the envelope can be said to include items and it is therefore rejected for manual inspection.

Note that the above method, in which the envelope is assumed to be opened out so that a single sheet thickness passes through the apparatus, can be applied using a single sensor although a plurality of sensors is preferred as the results will be more reliable.

FIG. 8(*a*) to 8(*d*) show examples of different mechanical sensors. FIG. 8(*a*) shows the sensor described above which has a roller 4 mounted on an arm 5 which pivots about a pivot point 6 on a housing 1. An optical sensor 7 is provided to monitor for movement of the arm 5 up and down to provide a measurement of that movement.

FIG. 8(*b*) shows an example in which a simple stylus 11 replaces the roller 4 of the example in FIG. 8(*a*).

In FIG. 8(*c*), the arm 5 is mounted on the housing 1 by a flexible strip 12 rather than by a pivot 6 as in the example of FIG. 8(*a*), the arm carrying a roller 4.

In FIG. 8(*d*), the arm 5 and roller 4 are replaced by a single relatively long flexible strip 13 fixed at one end to the housing 1 and at the other end to a vane 14, movement of which as the strip 13 passes over the envelope is detected by an optical detector 7.

FIG. 9(*a*) to 9(*d*) show examples of different techniques for determining the thickness measured by the thickness sensor. FIG. 9(*a*) shows the example described in detail above in which movement of the arm 5 up and down is monitored by an optical detector 7.

In FIG. 9(*b*), in which the arm 5 is fixed to the housing 1 by a short flexible strip 12 as shown in FIG. 8(*c*), a strain sensor 14 is fixed to the flexible strip 12. As the arm 5 moves and the strip 12 flexes, the strain sensor 14 detects the flexing of the strip 12 and outputs a signal which is representative of movement of the arm 5 up and down. The strain sensor 14 may be a piezoresistor, a piezoelectric material, or a semiconductor bonded to the flexible strip 12.

In FIG. 9(*c*), a capacitor 15 is formed between the arm 5 and another, fixed plate 16. As the arm 5 moves up and down, the capacitance varies according to the inverse of the distance between the plate 16 and the arm 5 in a well known way so that a measurement of the capacitance results in a measurement of displacement of the arm 5.

In FIG. 9(*d*), a magnet 17 is fixed to the arm 5 and the amount of movement of the magnet 17 is detected using a magneto-resistor or a Hall effect sensor 18, for example.

It will be appreciated that the detectors shown in FIGS. 9(*a*) to (*d*) are generally suitable for use with any of the thickness gauges shown in FIGS. 8(*a*) to (*d*).

Figure 10:
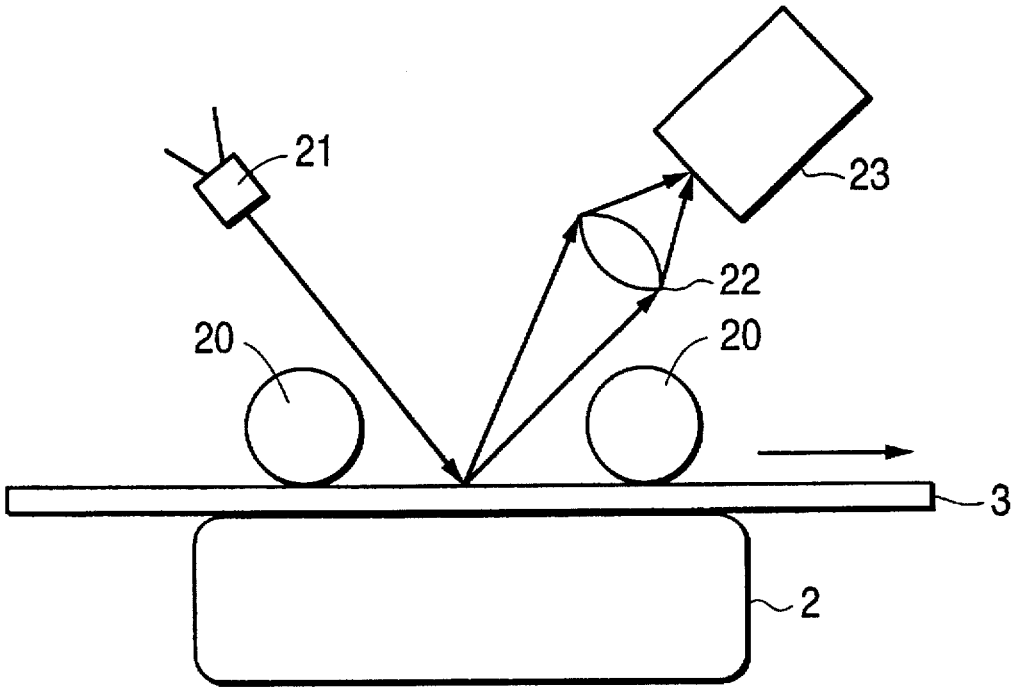

An example of a non-contact method for measuring the thickness of the envelope is shown in FIG. 10, the method using optical triangulation. The envelope 3 is passed over a platen 2 between rollers 20 which hold the envelope 3 flat on the platen 2. Light from a light source 21 such as a laser diode is directed onto the surface of the envelope 3. The reflected light is focused by a lens 22 onto a detector 23. The detector 23 is a position sensitive camera. As the thickness of the envelope 3 varies along its length (and over its width), the position at which the reflected beam strikes the light detector 23 varies and this variation can be used to measure the thickness of the envelope 3.

We claim:

1. A method of checking an envelope for contents, comprising the steps of:

measuring the thickness of the envelope at a plurality of points along the envelope;

determining a material thickness, or a multiple of the material thickness, for the material of the envelope from the measured thickness; and comparing the thickness of the envelope measured at the plurality of points with the determined material thickness, or the multiple of the material thickness of that envelope, and determining on the basis of such comparison whether or not the envelope has contents therein.

2. A method according to claim 1, wherein a mechanical thickness gauge (4,5) is used to measure the thickness of the envelope.

3. A method according to claim 2, wherein the mechanical thickness gauge comprises a single roller (4).

4. A method according to claim 2, wherein the mechanical thickness gauge comprises a plurality of rollers (7).

5. A method according to claim 3, wherein the roller is supported to pivot about a pivot point, the thickness of the envelope being measured by monitoring pivotable movement of the roller as it passes over the envelope.

6. A method according to claim 3, wherein the roller is supported by a flexible strip.

7. A method according to claim 2, wherein the mechanical thickness gauge is a stylus (11) which is supported to pivot about a pivot point (6), the thickness of the envelope (3) being measured by monitoring pivotable movement of the stylus as it passes over the envelope.

8. A method according to claim 2, wherein the mechanical thickness gauge is a flexible strip (13) which is fixed at one end and which contacts the envelope.

9. A method according to claim 2, wherein movement of the mechanical thickness gauge is monitored by optical means (7,8,9).

10. A method according claim 2, wherein movement of the mechanical thickness gauge is monitored by detecting movement of a magnet which is displaced as the thickness of the envelope is measured.

11. A method according to claim 6, wherein movement of the mechanical thickness gauge is monitored by a strain gauge (14) fixed to the flexible strip (12,13).

12. A method according to claim 1, wherein the thickness of the envelope (3) is measured by a non-contact method.

13. A method according to claim 12, wherein a position sensitive camera (23) detects movement of a light beam reflected from the surface of the envelope (3) as the light beam moves over the envelope (3).

14. A method according to any of claims 1, wherein the length of the envelope is measured.

15. Apparatus for checking an envelope for contents, comprising:

means for measuring the thickness of an envelope at a plurality of points along the envelope;

means for determining a material thickness, or a multiple of the material thickness, for the material of the envelope from the measured thickness; and means for comparing the measured thickness of the envelope with the determined material thickness, or the multiple of the material thickness of that envelope, and determining on the basis of such comparison whether or not the envelope has contents therein.

16. Apparatus according to claim 15, wherein the thickness measuring means comprises a mechanical thickness gauge (4,5,6,7).

17. Apparatus according to claim 16, wherein the mechanical thickness gauge includes a single roller (4).

18. Apparatus according to claim 16, wherein the mechanical thickness gauge includes a plurality of rollers (4).

19. Apparatus according to claim 17, wherein the roller is pivotably mounted on a support.

20. Apparatus according to claim 17, wherein the roller is supported by a flexible strip.

21. Apparatus according to claim 16, wherein the mechanical thickness gauge is a stylus (11) which is supported to pivot about a pivot point (6), the thickness of the envelope (3) being measured by monitoring pivotable movement of the stylus as it passes over the envelope.

22. Apparatus according to claim 16, wherein the mechanical thickness gauge is a flexible strip (13) which is fixed at one end and which contacts the envelope.

23. Apparatus according to claim 16, further comprising optical means for monitoring movement of the mechanical thickness gauge.

24. Apparatus according claim 16, wherein movement of the mechanical thickness gauge is monitored by detecting movement of a magnet which is displaced as the thickness of the envelope is measured.

25. Apparatus according to claim 20, further comprising a strain gauge fixed to the flexible strip for monitoring movement of the mechanical thickness gauge.

26. Apparatus according to claim 15, further comprising means for measuring the thickness of the envelope by a non-contact method.

27. Apparatus according claim 15, further comprising means for transporting envelopes through the thickness measuring means.

28. Apparatus for determining whether an envelope has contents, comprising:

a measuring device to measure a thickness of an envelope at a plurality of locations on the envelope; and a processor to determine a material thickness for the envelope by itself from the measured thickness, to compare the measured thickness of the envelope with the determined material thickness or a multiple of the material thickness of that envelope, and to determine on the basis of the comparison whether the envelope has contents.

29. A method of determining whether an envelope has contents, comprising:

measuring a thickness of an envelope at a plurality of locations on the envelope;

determining a material thickness for the envelope by itself based on the measured thickness;

comparing the thickness of the envelope measured at the plurality of locations with the determined material thickness or a multiple of the determined material thickness of that envelope; and determining whether the envelope has contents based on the comparison.

* * * * *